US009140109B2

(12) United States Patent
Suarez-Rivera et al.

(10) Patent No.: US 9,140,109 B2
(45) Date of Patent: Sep. 22, 2015

(54) METHOD FOR INCREASING FRACTURE AREA

(75) Inventors: Roberto Suarez-Rivera, Salt Lake City, UT (US); Dean M. Wulberg, Salt Lake City, UT (US); Timothy M. Lesko, Sugar Land, TX (US); Marc Jean Thiercelin, Ville d'Avray (FR); Gisele Thiercelin, legal representative, Ville d'Avray (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 569 days.

(21) Appl. No.: 13/515,229

(22) PCT Filed: Sep. 29, 2010

(86) PCT No.: PCT/IB2010/054404
§ 371 (c)(1),
(2), (4) Date: Jan. 11, 2013

(87) PCT Pub. No.: WO2011/070453
PCT Pub. Date: Jun. 16, 2011

(65) Prior Publication Data

US 2013/0140020 A1 Jun. 6, 2013

Related U.S. Application Data

(60) Provisional application No. 61/282,061, filed on Dec. 9, 2009.

(51) Int. Cl.
*E21B 43/26* (2006.01)

(52) U.S. Cl.
CPC ..... *E21B 43/26* (2013.01)

(58) Field of Classification Search
CPC ... E21B 41/0035; E21B 43/14; E21B 43/162; E21B 43/26; E21B 43/267
USPC ..... 166/245, 50, 177.5
See application file for complete search history.

(56) References Cited

U.S. PATENT DOCUMENTS 3,223,158 A * 12/1965 Baker ..... 166/259
3,490,527 A * 1/1970 Cook et al. ..... 166/245

(Continued)

FOREIGN PATENT DOCUMENTS

EP 0166518 8/1988
GB 2434167 9/2008

OTHER PUBLICATIONS

Suarez-Rivera, et al, "Hydraulic Fracturing Experiments Help Understanding Fracture Branching in Tight Gas Shales," ARMA/USRMS 06.

(Continued)

*Primary Examiner* — Kenneth L Thompson
(74) *Attorney, Agent, or Firm* — Robert A. Van Someren; Wayne I. Kanak

(57) ABSTRACT

A technique enables improvements in hydraulic fracturing treatments on heterogeneous reservoirs. Based on data obtained for a given reservoir, a fracturing treatment material is used to create complex fractures, which, while interacting with the interfaces and planes of weakness in the reservoir, develop fracture connectors, e.g. step-overs, which often grow for short distances along these planes of weakness. The technique further comprises closing or sealing at least one of the fracture connectors to enable reinitiation of fracturing from the truncated branches, and to subsequently develop additional connectors. As a result, the overall fracturing becomes more complex (more branches and more surface area per unit reservoir volume is created), which leads to an increase in the effective fracture area and improved fluid flow through the reservoir.

6 Claims, 14 Drawing Sheets

(56) References Cited

U.S. PATENT DOCUMENTS

| | | | | |
|---|---|---|---|---|
| 3,500,913 | A * | 3/1970 | Closmann et al. | 166/259 |
| 3,933,205 | A * | 1/1976 | Kiel | 166/308.1 |
| 4,005,750 | A * | 2/1977 | Shuck | 166/308.1 |
| 4,718,490 | A * | 1/1988 | Uhri | 166/281 |
| 4,834,181 | A * | 5/1989 | Uhri et al. | 166/281 |
| 5,074,359 | A * | 12/1991 | Schmidt | 166/280.1 |
| 5,165,276 | A | 11/1992 | Thiercelin | |
| 5,228,510 | A * | 7/1993 | Jennings et al. | 166/263 |
| 5,330,005 | A | 7/1994 | Card et al. | |
| 5,351,754 | A | 10/1994 | Hardin et al. | |
| 5,551,344 | A | 9/1996 | Couet et al. | |
| 5,669,448 | A | 9/1997 | Minthorn et al. | |
| 6,138,753 | A | 10/2000 | Mohaupt | |
| 6,599,863 | B1 | 7/2003 | Palmer et al. | |
| 6,631,783 | B2 * | 10/2003 | Khan | 181/108 |
| 6,837,309 | B2 | 1/2005 | Boney et al. | |
| 7,139,219 | B2 | 11/2006 | Kolle et al. | |
| 7,284,612 | B2 | 10/2007 | Ratanasirigulchai et al. | |
| 7,380,600 | B2 | 6/2008 | Willberg et al. | |
| 7,380,601 | B2 | 6/2008 | Willberg et al. | |
| 7,413,017 | B2 | 8/2008 | Nguyen et al. | |
| 7,506,689 | B2 | 3/2009 | Surjaatmadja et al. | |
| 7,565,929 | B2 | 7/2009 | Bustos et al. | |
| 8,347,959 | B2 | 1/2013 | Suarez-Rivera et al. | |
| 2005/0263283 | A1 | 12/2005 | Nguyen | |
| 2006/0054324 | A1 | 3/2006 | Sullivan et al. | |
| 2006/0113077 | A1 | 6/2006 | Willberg et al. | |
| 2007/0023184 | A1 | 2/2007 | Jackson et al. | |
| 2008/0000639 | A1 | 1/2008 | Clark et al. | |
| 2008/0162098 | A1 | 7/2008 | Suarez-Rivera et al. | |
| 2008/0200352 | A1 | 8/2008 | Willberg et al. | |
| 2008/0289823 | A1 | 11/2008 | Willberg et al. | |
| 2009/0065198 | A1 | 3/2009 | Suarez-Rivera et al. | |
| 2009/0319243 | A1 | 12/2009 | Suarez-Rivera et al. | |
| 2010/0282471 | A1 * | 11/2010 | Watson | 166/308.1 |

OTHER PUBLICATIONS

M. Thiercelin, "Hydraulic Fracture Propagation in Discontinuous Media", Schlumberger Regional Technology Center, Unconventional Gas Addition, Texas, USA 92009.

Wenyue Xu, et al, Characterization of Hydraulically-Induced Share Gracture Network Using an Analytical/Semi-Analytical Model, SPE 124697.

* cited by examiner

METHOD FOR INCREASING FRACTURE AREA

CROSS-REFERENCE TO RELATED APPLICATION

The present application claims priority from U.S. Provisional Application Ser. No. 61/282,061, filed Dec. 9, 2009, which is incorporated herein by reference.

BACKGROUND OF THE INVENTION

Exploitation of oil and gas reserves can be improved by increasing fracture area during hydraulic fracturing to enhance hydrocarbon production. Many fracturing techniques have been employed to fracture one or more rock formation of a given reservoir to improve the conductivity and flow of hydrocarbon fluids to a wellbore. In many types of rock formations, however, existing fracture techniques are limited in providing an optimal effective fracture area. As a result, well production and recovery of hydrocarbon fluids within the reservoir are restricted.

BRIEF SUMMARY OF THE INVENTION

In general, the present invention provides a technique of improving a hydraulic fracturing treatment on heterogeneous formation. According to one embodiment, data is obtained and used to evaluate a given heterogeneous reservoir. Based on the data obtained, a fracturing treatment material is used to create complex fractures having fracture connectors, e.g. step-overs, which often grow for short distances along planes of weakness (e.g., mineralized fractures, bed boundaries, lithological interfaces). The technique further comprises closing at least some of the fracture connectors to enable initiation of a subsequent fracturing treatment to create additional fracture connectors and/or to extend the step-over length. As a result, the overall fracturing becomes more complex, which leads to an increase in the effective fracture area and improved fluid flow through the reservoir.

BRIEF DESCRIPTION OF THE DRAWINGS

Certain embodiments of the invention will hereafter be described with reference to the accompanying drawings, wherein like reference numerals denote like elements, and.

DETAILED DESCRIPTION OF THE INVENTION

Figure 1:
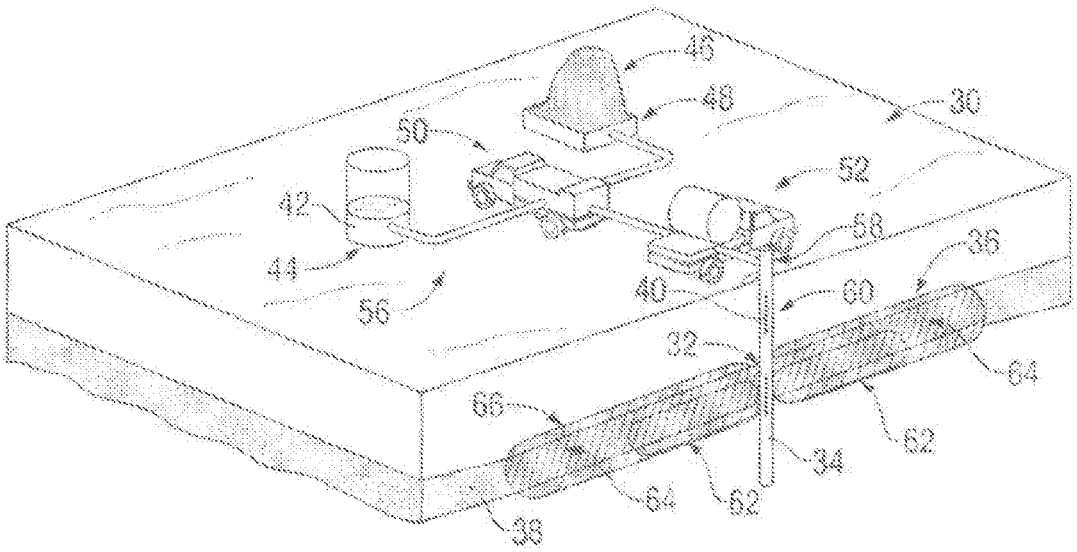
FIG. 1 is a view of a wellsite at which a fracturing operation is underway.

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a technique of improving a fracturing treatment in a subterranean environment. The technique provides for enhanced stimulation of heterogeneous hydrocarbon reservoirs to increase the effective fracture surface area and fracture connectivity. The increased surface area and connectivity causes increased well productivity and enhances the ultimate recovery of hydrocarbons. The enhanced stimulation may be provided by a variety of fracturing techniques, such as hydraulic fracturing, propellant fracturing, coiled tubing fracturing, acid fracturing, or other fracturing techniques. The present technique may also enhance the fracture network by employing a variety of components, aspects, cycles, and cycle changes. Effectively, the technique enables control of the evolution of fracture complexity and is designed to promote the closure of fracture connectors and the initiation of additional fractures from truncated branches in heterogeneous formations.

As described in greater detail below, the technique expands upon acquired knowledge of fracture complexity found in, for example, Suarez-Rivera et al., (2006) *Hydraulic Fracturing Experiments Help Understanding Fracture Branching in Tight Gas Shales*, ARMA/USRMS 06; Thiercelin, *Hydraulic Fracture Propagation in Discontinuous Media*, Schlumberger Regional Technology Center, Unconventional Gas, Addison, Tex. USA (2009); and Wenyue Xu et al., (2009) *Characterization of Hydraulically-Induced Shale Fracture Network Using an Analytical/Semi-Analytical Model*, SPE 124697. The present technique enhances fracturing by strategically using mechanical, chemical, thermal, and/or hydraulic mechanisms during the fracturing operation. The result is a significant increase in effective fracture area and fracture complexity to enable better well production and recovery. The increased fracture complexity can be monitored via acoustic emission monitoring, and the beneficial results can be measured by tracking well production and evaluating hydrocarbon recovery from the reservoir.

The technique also relates to understanding and detecting the conditions required for generating fracture complexity, high fracture density, and large surface area during fracturing. For example, the technique involves gaining an understanding of the degree of textural heterogeneity in the reservoir to infer the type of fracture complexity anticipated, including the length and orientation of the step-overs, to potentially promote additional complexity. The knowledge is used to anticipate fracture geometry and to evaluate formation factors, such as minimum fracture pressure requirements for maintaining hydraulic conductivity within the fracture network. Better control over fracture complexity enables positive consequences such as increased surface area per unit reservoir volume to enhance flow of hydrocarbons from the rock matrix to the wellbore, thus increasing recovery of hydrocarbons. The control over fracture complexity enabled by the present technique may also help reduce potentially negative consequences such as an increase in tortuosity of flow paths, detrimental effects on proppant transport and placement, and associated difficulties in preserving fracture conductivity.

Sources of fracture complexity include the presence of textural discontinuities and interfaces, e.g. mineralized fractures, which affect hydraulic fracture propagation and cause the fracture to generate step-overs during propagation via shear displacement. Step-overs are small connecting fracture branches/connectors that grow for short distances along planes of weakness. The planes of weakness may be parallel, normal, or obliquely oriented with respect to the maximum horizontal stress, or with respect to the vertical stress in some heterogeneous formations. Vertical stress can play a role in fracture height propagation. In the absence of planes of weakness, a hydraulic fracture eventually reorients itself to the direction generally perpendicular to the minimum horizontal stress. In some cases, as the fracture leaves an interface, additional shear displacement and reorientation result in multiple branches exiting the interface. In these cases, the fracture connectors are subjected to a significantly higher closure stress and are kept open by the pressure increase associated with the tortuosity of the flow. Depending on the magnitude of the event and its relation to the signal/noise ratio of a data acquisition system, the connectors/step-over events may be recorded in a treatment pressure record as a step or gradual increase in pressure. As the fracture reorients and continues propagating in the direction perpendicular to the minimum horizontal stress, the net pressure typically is defined by the pressure losses along the various step-overs and their orientation in relation to the maximum stress, particularly those near the fracture tip. For example, step-overs closer to the fracture tip produce the highest pressure drop. Existing step-overs created earlier, remain relatively wide open and have a lesser contribution to the pressure drop.

Based on an understanding of the connector/step-over events, flow conditions may be created so the pressure for maintaining these connectors open is decreased below a critical value to close the connectors/step-overs. The closure isolates corresponding fracture branches. Each isolated branch remains pressurized and contributes to a local increase in the minimum horizontal stress over the region where it has propagated. To resume fracturing from a truncated branch, a locally increased horizontal stress must be overcome. This typically results in propagation of new fractures along a different path or paths, providing an associated increase in effective surface area and fracture conductivity. The effective surface area is the component of the surface area that remains open during production.

Referring generally to FIG. 1, on embodiment of a well system 30 is illustrated as having a well 32 formed by drilling a wellbore 34 down into a reservoir 36 having at least one subterranean formation 38. In this embodiment, the reservoir 36 is undergoing a fracturing operation in which a fracture treatment material 40, e.g. a fracturing fluid, is delivered down to reservoir 36 through appropriate equipment deployed in wellbore 34. (For simplicity, a planar, bi-wing, and symmetrical fracture is displayed. In practice, this may have different degrees of complexity, may have multiple branches, and may lack symmetry.)

In this particular example, fracture treatment material 40 is formed by mixing a fracturing fluid 42, which may be stored in a fracturing fluid tank 44, with a proppant 46, e.g. a sand proppant, which may be located in a surface container 48. The fracturing fluid 42 and proppant 46 are mixed in a blender 50 to form fracture treatment material 40. The fracture treatment material 40 is pumped from blender 50 via pumper unit 52, which may be positioned at wellsite 56 along with blender 50. The pumper unit 52 delivers fracture treatment material 40 through a wellhead 58 and down into wellbore 34 via a tubing string 60 and other appropriate equipment designed to deliver the fracture material 40, e.g. fracturing fluid slurry, into reservoir 36.

As the fracture treatment material 40 is delivered into reservoir 36, the proppant 46 is deposited through regions 62 while fracturing fluid 42 flows into larger reservoir regions 64. The result is creation of fracture 66 in reservoir 36. As discussed in greater detail below, the present technique for fracturing reservoir 36 enables creation of step-overs which are small connecting fracture branches/connectors that significantly increase the effective fracture area and improve well production and hydrocarbon recovery. The example illustrated in FIG. 1 may be considered a hydraulic fracturing technique which is very useful for tight reservoirs, e.g. tight sands and shales, to create extensive surface area for economic production. However, other types of fracturing may also be employed with the present technique to significantly increase the effective fracture area within reservoir 36.

Figure 2:
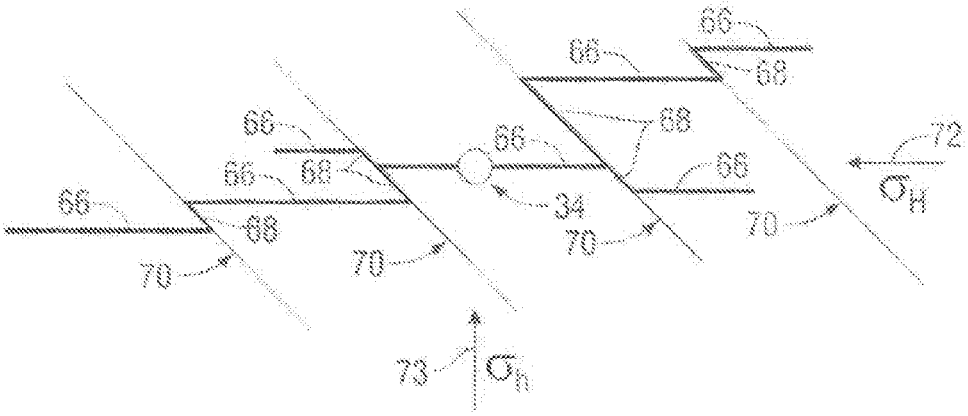
FIG. 2 is a schematic illustration of fracture complexity in a reservoir.

In FIG. 2, a schematic illustration is provided to show the creation of fracture 66 extending outwardly from wellbore 34 and the creation of step-overs 68 to significantly increase the effective fracture area and fracture density. This type of complexity is not observed in conventional, homogeneous reservoirs. In heterogeneous reservoirs, some of the principal sources of fracture complexity are the textural discontinuities and interfaces 70, e.g. mineralized fractures, bed boundaries, lithologic contacts, which affect hydraulic fracture propagation. Through shear displacement, discontinuities 70 cause the fracture to generate the step-overs 68 during propagation. Step-overs provide small connecting fracture branches or connectors which grow for short distances along planes of weakness which may be parallel, normal, or obliquely oriented in relation to a maximum horizontal or vertical stress 72 oriented perpendicular to a minimum stress 73.

Figure 3:
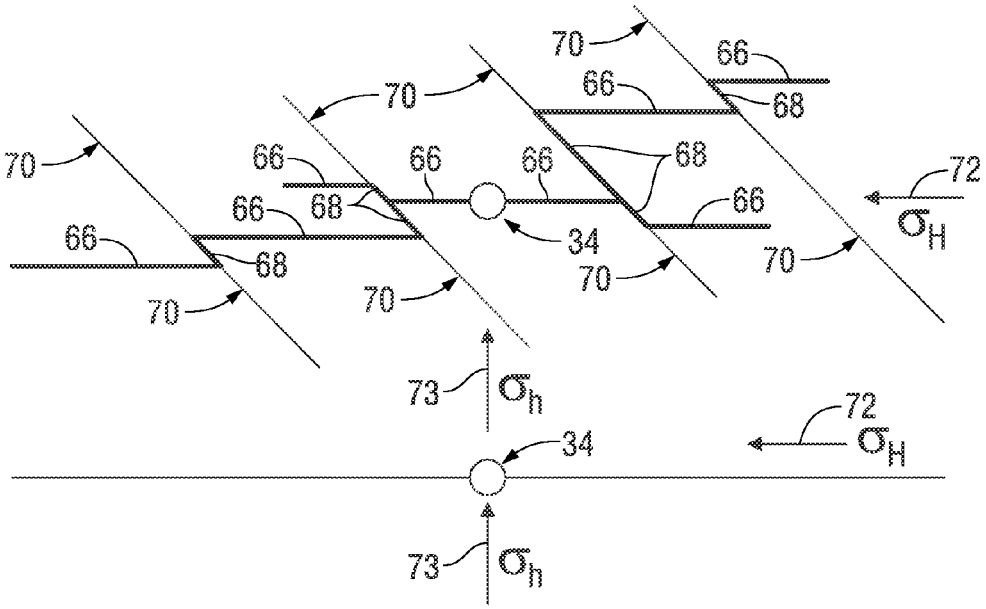
FIG. 3 is a schematic illustration showing increased surface area resulting from complex fracture generation in contrast to simple fractures.

Complex fracture generation results in increased surface area per unit reservoir volume, and it also causes a corresponding increase in reservoir production and ultimate recovery from the reservoir. The ultimate recovery increases as a function of the fracture density, particularly because of the pore pressure depletion interaction that develops between closely spaced fractures. In contrast, simple fractures without branches, even when providing an equivalent surface area, drain only the reservoir region adjacent to the fracture, thus resulting in limited reservoir recovery. FIG. 3 provides a schematic example comparing a simple fracture extending from a wellbore (see lower portion of figure) with a complex fracture having numerous step-overs 68 (see upper portion of figure). Even if the surface areas are equivalent, the more complex fracture in the upper portion enables better drainage and substantially improved recovery.

Figure 4:
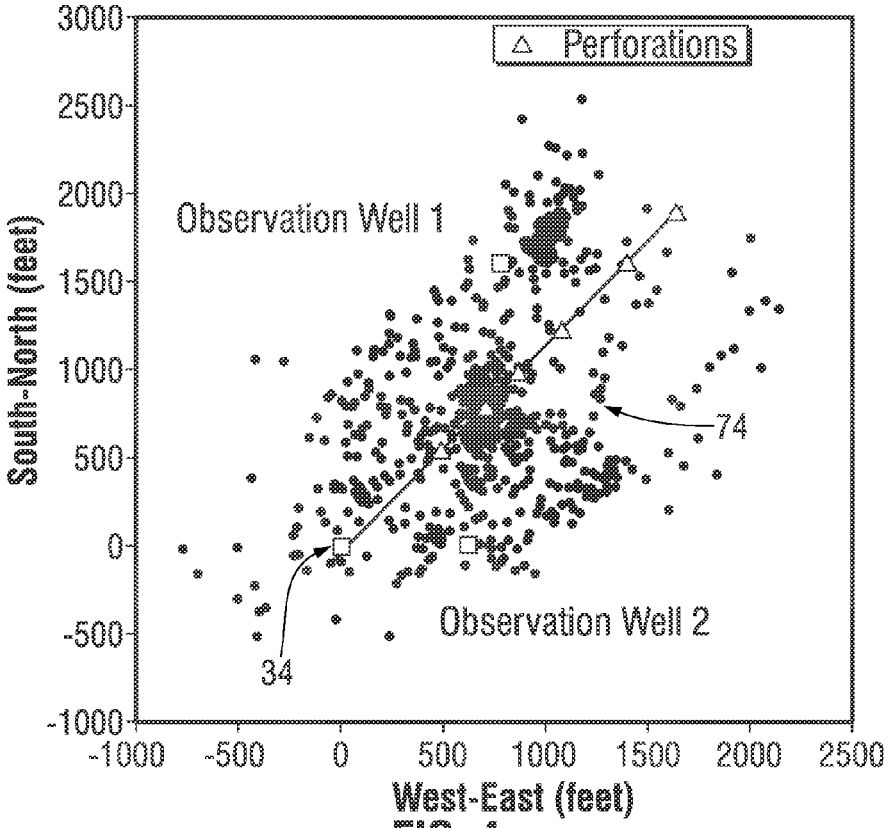
FIG. 4 is a schematic illustration of data generated by a real-time fracture monitoring system.

An operator is better able to track and understand creation of the complex fracture generation by employing a suitable monitoring technique. For example, creation of fracture complexity may be monitored by a seismic monitoring system detecting microseismic acoustic emissions activity and mapping the regional distribution of these events as the fracturing treatment progresses. In FIG. 4, a graph is provided to illustrate the monitoring of microseismic acoustic emissions activity in the form of markers 74 which represent the detection of microseismic acoustic emissions corresponding with the creation of step-overs 68 and other fracture generation. A strong relationship exists between the surface area created and the number of microseismic events recorded. Accordingly, the use of markers 74 to graph acoustic emission events throughout reservoir 36 enables an operator to better understand the increase in effective surface area throughout the reservoir 36. Basically, an increase in acoustic emission events is associated with a corresponding increase in surface area.

Additionally, an increased number of microseismic acoustic events localized in the same region indicate an increase of fracture density, i.e. additional branches are created in the neighborhood of the initial fracture. If, on the other hand, the acoustic emission events are mapped as propagating away from an initial location, this indicates an increase in fracture length. Accordingly, an operator can focus on increasing the density of emission events in a particular region to effectively increase fracture density in this region, thereby enabling increased production and increased recovery. The present technique provides control over the development of fracture density, as indicated by acoustic emission density, through modifications during treatment. For example, modifications may be made with respect to fracture treatment material pressure and fracture treatment material flow rate. The effects of these changes are monitored, as illustrated by the example of FIG. 4. The monitoring may be carried out in real-time to facilitate various adjustments to the treatment regimen in a manner which enables control over the fracture density. Given that reservoirs are different from each other and that the behavior during fracturing is often different from stage to stage, the present technique enables optimization of conditions for maximizing fracture density and increasing microseismic events in real-time.

Figure 5:
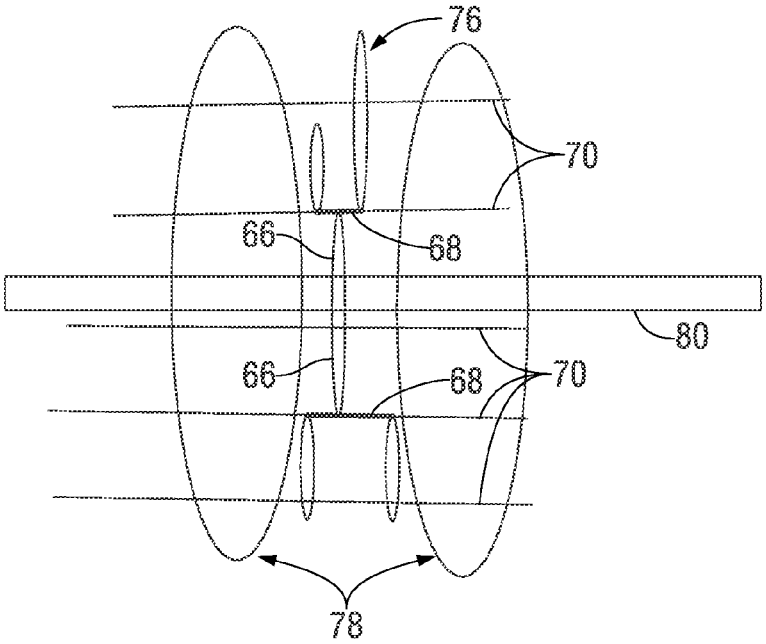
FIG. 5 is an illustration of regions of altered shear stress in a complex formation fracture.

Various methodologies are available for promoting self propping of complex fractures and for enhancing fracture conductivity. In one example, a pre-fracturing stage employs Portland cement to create a disturbed state of stress upon setting of the cement, thus increasing the shear stresses in the near fractured region. The desired fracture is then placed within this region. A schematic example of this is illustrated in FIG. 5, in which a pre-fracture 76 is created to change the near region stress and to create regions of altered shear stress 78 along, for example, a horizontal wellbore section 80. The additional shear stress promotes shear displacement between the fracture surfaces and causes higher fracture conductivity. The present technique expands such approaches through the effect of a shear-induced increase in fracture conductivity by previously created fracture branches, by the truncation of these fracture branches, and by the generation of additional branches from truncated nodes. Additionally, instead of requiring two separate operations of fracturing, the present approach may be used to accomplish similar phenomena during a single hydraulic fracturing operation.

According to one embodiment, the present technique involves evaluating formation textural complexity, such as orientation and distribution of planes of weakness in relation to the in-situ stress orientation. Based on the collected data, the fracturing technique is designed to better generate complex fractures with multiple branches. These branches generally are created in the horizontal direction of fracture propagation if the interfaces are oriented sub-vertically. The branches may also be created in the upward and downward directions of propagation if the interfaces are oriented sub-horizontal. In either case, the interfaces induce step-overs 68 of changed orientation to create the connectors/branches between fracture branches.

Figure 6A:
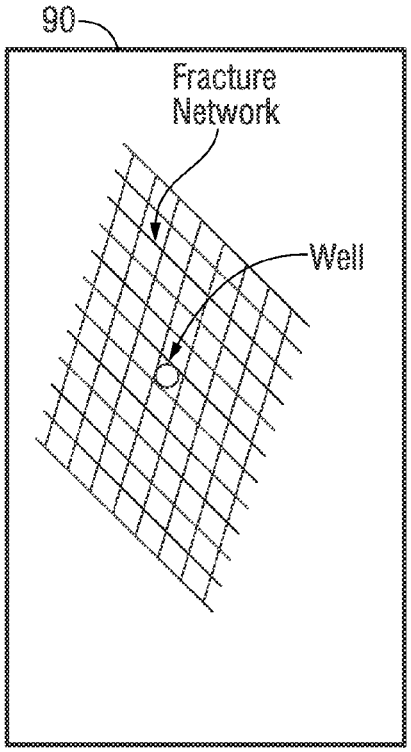
FIGS. 6A-6D are illustrations of fracture complexity which can result form an understanding of the reservoir fabric.
Figure 6B:
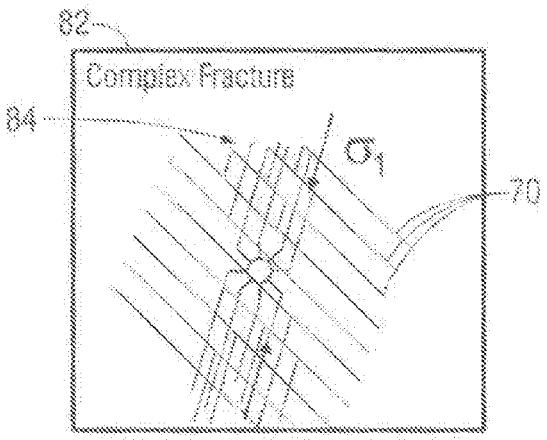
Figure 6C:
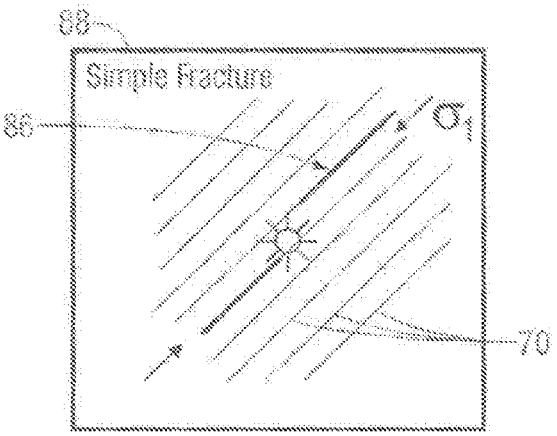
Figure 6D:
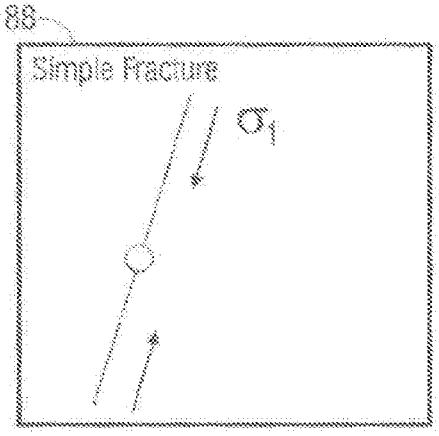

Fracture complexity is facilitated when the interfaces/discontinuities 70, e.g. mineralized fractures, are oriented obliquely to the direction of the maximum stress, as illustrated in the schematics of FIGS. 6A-6D. It should be noted that the maximum stress can be a vertical stress. For example, in the case of a horizontal discontinuity the vertical stress is also a controlling parameter. In FIG. 6B, box 82 of the schematic, a complex fracture structure 84 is illustrated as resulting when the maximum horizontal stress is oriented obliquely with respect to the interfaces 70. In contrast, a simple fracture 86 results when the maximum horizontal stress is oriented generally parallel with respect to interfaces 70, as illustrated in FIGS. 6C and 6D, boxes 88. Reservoirs which do not exhibit substantial interfaces 70 are less amenable to the creation of complex fracture structures 84. Accordingly, understanding the potential for development of fracture complexity requires an understanding of material properties and reservoir fabric (i.e., the presence, density, and orientation of interfaces and directions of weakness), as represented by FIG. 6A, box 90. If should be noted that the present technique is applicable to heterogeneous reservoirs and involves gaining an understanding of the degree of textural heterogeneity in the reservoir to infer the type of fracture complexity anticipated. By way of specific example, the cohesion and friction angle of the interface or interfaces 70 which results from the contrast in properties between two media provides an understanding of the reservoir fabric for a given reservoir. This understanding, in turn, enables selection of appropriate reservoirs and implementation of appropriate fracturing techniques to achieve the desired fracture complexity.

Depending in the orientation of the main fracture branches 66 and the orientation of the fracture connectors/step-overs 68, pressure requirements for maintaining the connectors open may be established. Reducing fracturing pressures below this opening pressure results in closure of the connectors 68, and thus isolation of the corresponding pressurized fracture branches 66. The isolated, open fracture branches may change the shear stresses in the neighboring region. As a result, reinitiating fracture propagation requires increasing the treatment pressure beyond the previously established propagation pressure. Changes in the local stress in the fracture region prevent the connectors/step-overs 68 from reestablishing their previous connectivity to the isolated branches and thus new fractures are created. As a result, a new breakdown pressure is observed via an associated surge of acoustic emissions which may be measured and plotted (see, for example, FIG. 4).

Figure 7A:
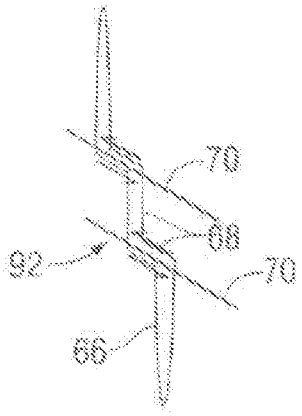
FIGS. 7A and 7B are illustrations of the propagation of secondary branches to create a more complex fracturing.
Figure 7B:
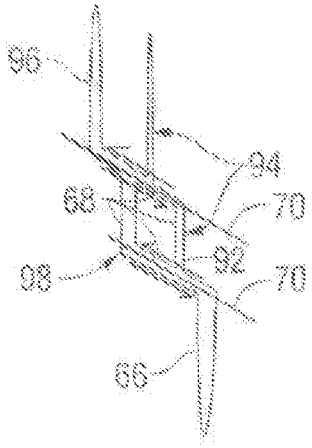

Referring generally to FIGS. 7A and 7B, a schematic illustration is provided to show the creation of new fractures following fracture closure. In FIG. 7A, an initial fracture 66 is created at a generally oblique angle with respect to interfaces 70. The initial fracture 66 comprises connectors or offsets 68 that extend a short distance along the interfaces 70. A connecting branch extends between interfaces 70 from a tip or node 92 of the sheared, activated zone. As pressure is reduced below the opening pressure, branches 94 of the original fractures close as indicated in FIG. 7B. When fracture propagation is reinitiated by increasing the treatment pressure beyond the previously established propagation pressure, additional fracture branches 96 are formed as established by a new tip 98 of the sheared, activated zone. Consequently, the effective surface area is increased via the higher fracture density, thereby improving the flow of hydrocarbon fluid through the reservoir.

Creation of complex fracture structures works well in tight formations that benefit from a large surface area for production. The technique also is amendable to use in stiff formations with strong coupling between deformation and stress development. Examples of these types of stiff formations include tight sands, tight shales, and tight carbonates producing oil and/or gas. The technique also is applicable to tight hydrothermal reservoir rocks and other suitable formation types.

The present technique is facilitated by gaining an understanding of the pressure distributions within complex fractures having multiple branches; by promoting the closure of fracture connectors to cause isolation of fracture branches; and by reinitiating fractures at the truncated nodes. The fracturing and reinitiating of fracturing procedure benefits from an understanding of and control over the fracturing fluid pressure distribution. The fracture pressure distribution can be controlled via a variety of techniques, including use of mechanical devices placed at the wellbore or downhole, modification of a pumping schedule, or employment of external devices (either uphole or downhole) to control the pressure and fluid flow at the fracture. Modifying the pumping schedule may comprise, for example, using batches of fluids or adding special additives with properties suitable for the type of pressure changes desired.

Figure 8:
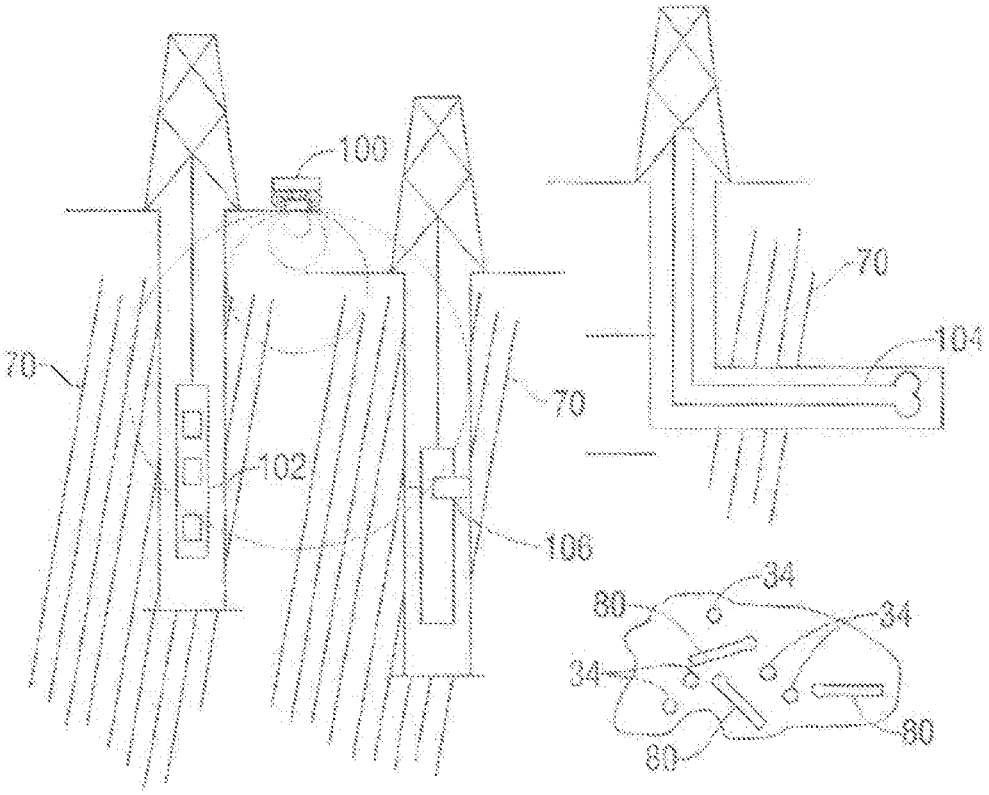
FIG. 8 is an illustration demonstrating various evaluations which may be made to understand and define the reservoir fabric.

In FIGS. 8-19, embodiments of a procedure for carrying out the present methodology are illustrated. Referring initially to FIG. 8, illustrations are provided of techniques for gaining an initial understanding of the subject reservoir 36 to undergo the present technique for creating complex fracturing. To improve fracture creation and density, the reservoir fabric, discontinuities (e.g. mineralized fractures), and other aligned interfaces or planes of weakness, are identified and evaluated through one or more techniques. For example, seismic instruments 100 may be employed for large-scale seismic prospection. Additionally, one or more logging tools 102 and/or measurement while drilling tools 104 may be employed to provide wellbore imaging and detection of reservoir characteristics, such as discontinuities, e.g. mineralized fracture sets. In many applications, sampling tools 106 may be used to obtain formation samples, e.g. cores, which enable visual observations of the core and/or sidewall plugs. Each of these techniques can be valuable in evaluating the reservoir and the orientation of discontinuities/interfaces 70.

The logging tool 102 and other detection devices may also be used to determine the magnitude of the minimum and maximum horizontal stress 73, 72. The horizontal stress data may be obtained from log measurements (e.g. borehole breakouts or induced tensile fracturing) or measurements on cores (e.g. anisotropic elastic properties and gravity loading calculations). The vertical stress may be determined from the density log.

Figure 9:
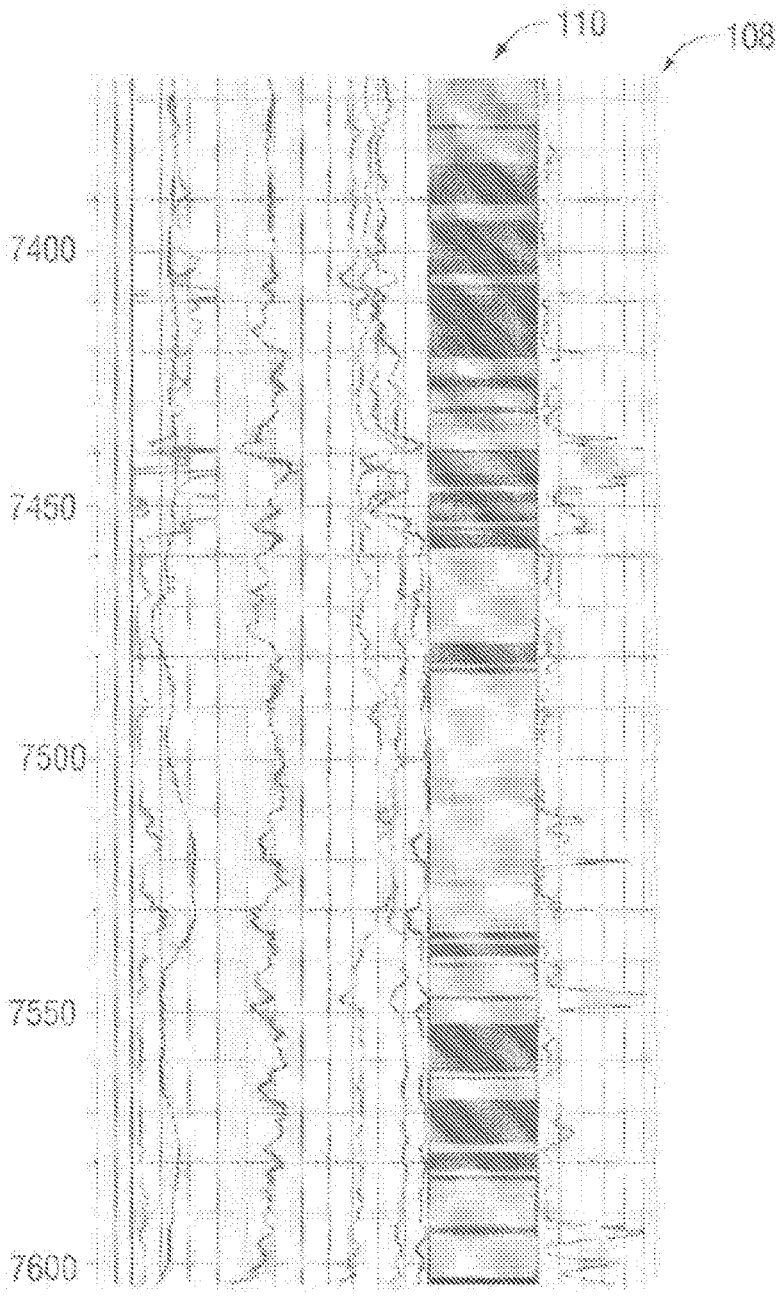
FIG. 9 is an illustration of a graphical output identifying principal rock classes in a reservoir.

Additionally, vertical and lateral heterogeneity of the reservoir 36 may be defined by evaluation of the principal rock classes identified from log measurements, an example of which is illustrated in FIG. 9. According to one example, the analysis is performed using heterogeneous rock analysis of logs which define all reservoir and non-reservoir units comprising the heterogeneous system. The rock classes may be identified on a suitable display screen 108, e.g. a computer display screen, as bands or units 110 indicating similar and dissimilar rock material properties. However, a variety of other methodologies may be employed to define rock units in a manner which facilitates selection of fracturing techniques for creating the complex fractures with increased effective surface area and fracture density.

Figure 10:
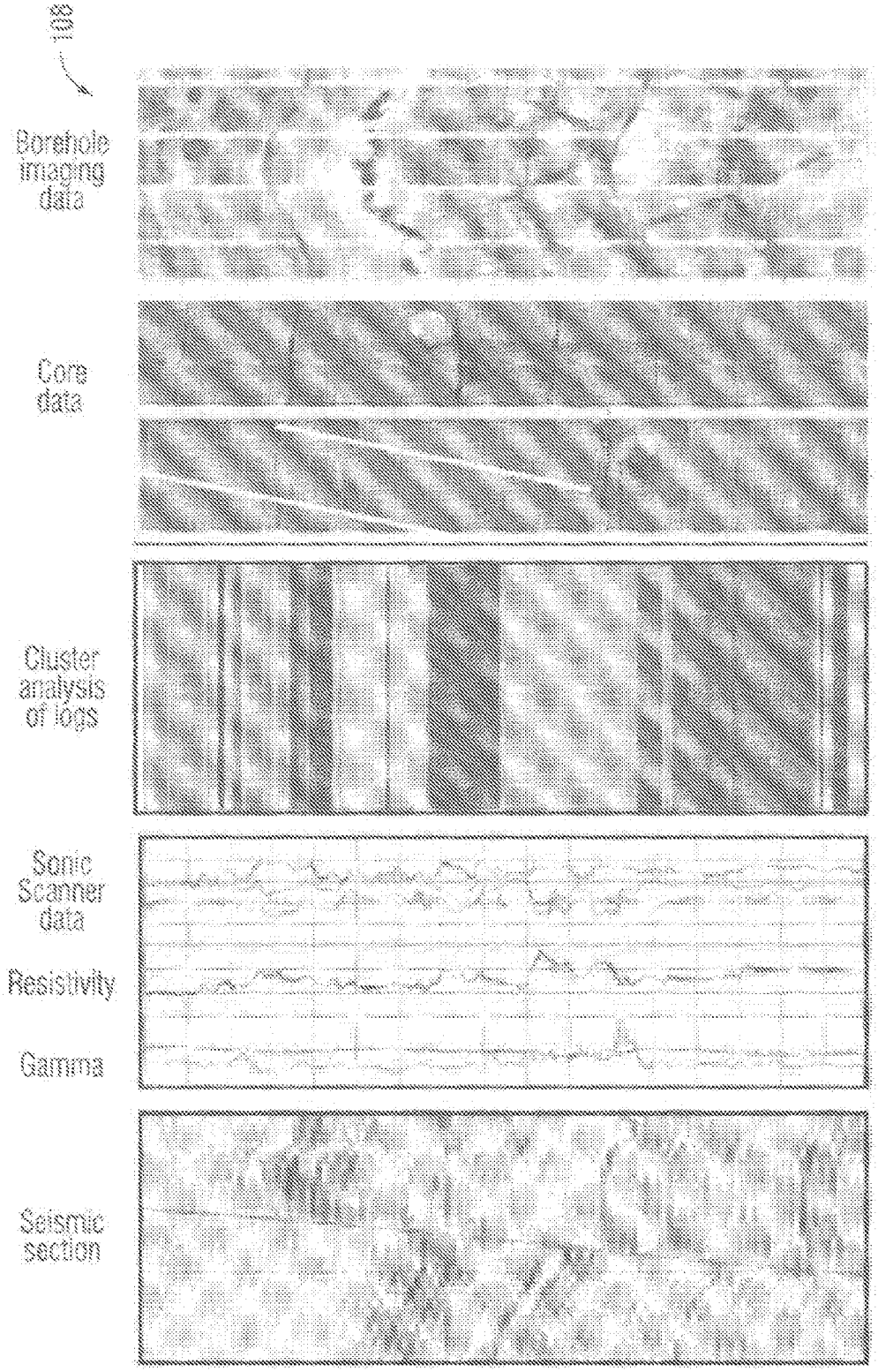
FIG. 10 is an illustration of a graphical outputs providing information on a given reservoir gathered according to a plurality of techniques.

The data collected from the various detection and evaluation techniques may be integrated on, for example, a computer or other type of processing system. Information may be output graphically on a computer screen or other display device 108 as illustrated in FIG. 10. By way of example, the integrated information may include seismic data, log analysis, rock facies breakdown, core analysis, analysis of borehole images, and other information. The collected information enables an operator to define the presence, orientation, and density of discontinuities 70, e.g. mineralized fractures, and other features contributing to the reservoir fabric on a rock class by rock class basis. In some applications, additional testing may be carried out to help evaluate properties of each rock class and to define reservoir quality and completion quality. Examples of additional testing include laboratory testing on mechanical and reservoir properties and/or specialized petrophysical log analysis to infer desired information from the logs.

Favorable or unfavorable orientation of the mineralized fractures 70 as well as other contributors to the reservoir fabric, combined with evaluation of the horizontal stress, enable prediction of the potential for fracture complexity during a fracturing treatment. A high density of mineralized fractures 70 oriented obliquely to the maximum horizontal stress 72 is a favorable condition for developing fracture complexity. However, the absence of mineralized fractures 70 or their orientation parallel a complex fracture structure. The collection of this data enables a pre-treatment conceptualization of the fracture development and provides the potential for development of models and/or numerical simulations.

Once fracturing is initiated, real-time monitoring of microseismic events provides an understanding of the actual development of fracture complexity. As discussed above the illustrated in FIG. 4, the microseismic events may be detected and plotted to enable real-time evaluation of the fracturing progression. The data enables comparison and validation of the degree of complexity expected/predicted with the actual degree of fracture complexity. By comparing the acoustic emission measurements with the predicted fracture growth, predictive models can be modified and predictions may be recalculated until the measured data and the predicted fracture geometry are in reasonable agreement.

Figure 11A:
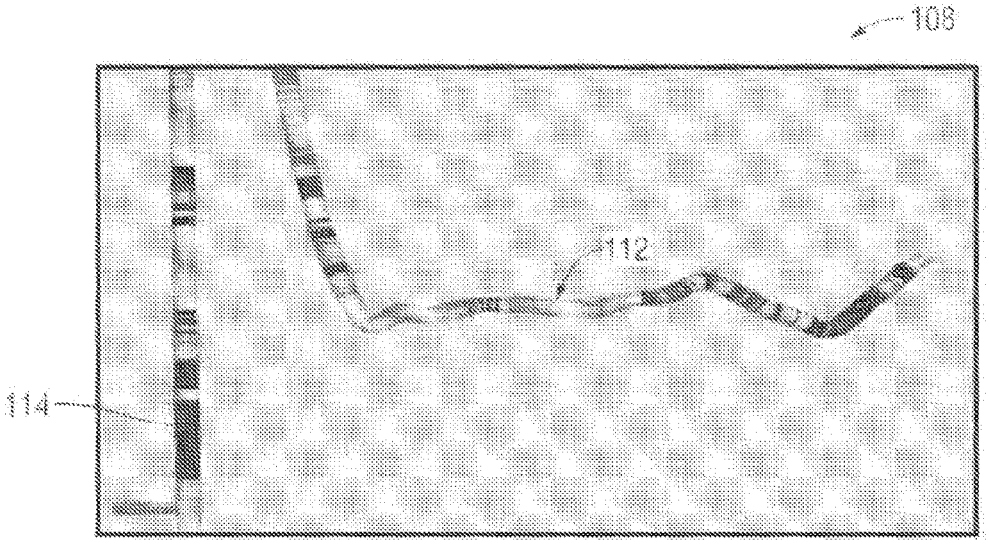
FIGS. 11A and 11B are illustrations showing the integration of measured data and rock classification to gain a better understanding of both vertical and lateral wells.
Figure 11B:
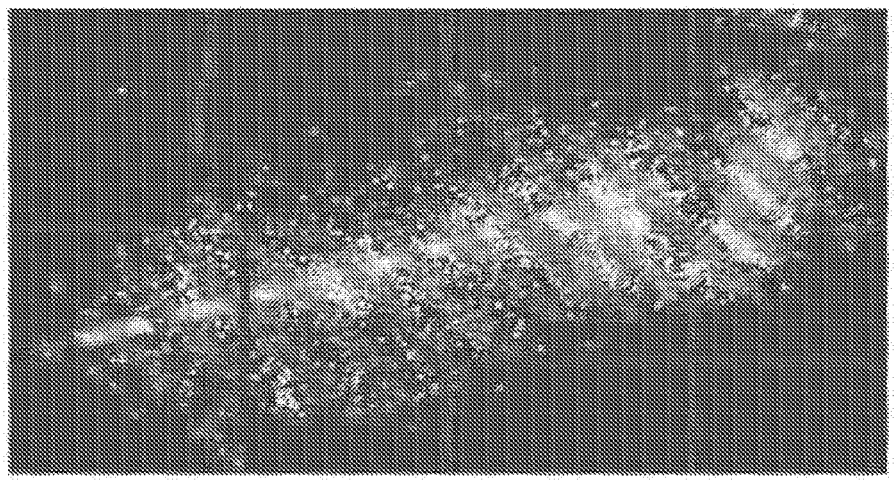

The observation of microseismic events indicative of fracturing location and density (FIG. 11B) may be combined with information obtained on lateral heterogeneity and distribution of rock classes. In FIG. 11A, for example, a graphical representation is output to display 108 indicating lateral heterogeneity and distribution of rock classes along a lateral wellbore 112. The information related to lateral wellbore 112 is obtained by integrating the known variability and rock class characterization along a vertical well 114 with information along the lateral wellbore 112. Accordingly, the observation techniques may be employed to obtain information for both vertical and horizontal wells. Obtaining the horizontal well information may be achieved through rock class tagging of log responses as described in, for example, Patent Application Publication U.S. 2009/0319243, incorporated herein by reference. However, alternate methodologies also may be employed to obtain the information. The result is a classification of variability along the horizontal well to define perforation intervals and to identify zones with maximum potential for fracture complexity.

Figure 12A:
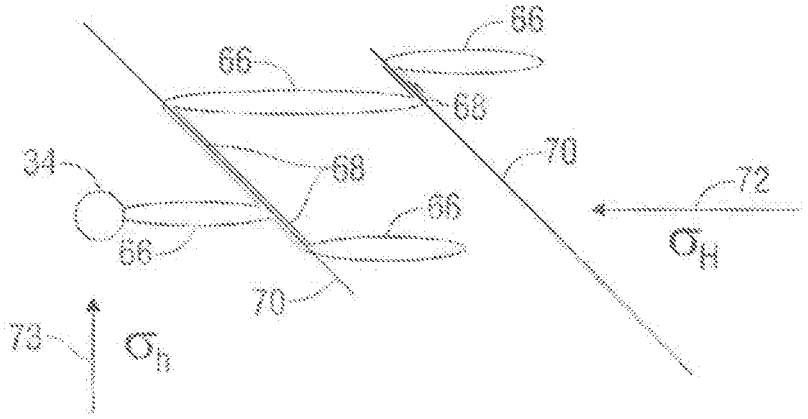
FIGS. 12A and 12B are illustrations of hydraulic fracturing induced propagation in a reservoir.
Figure 12B:
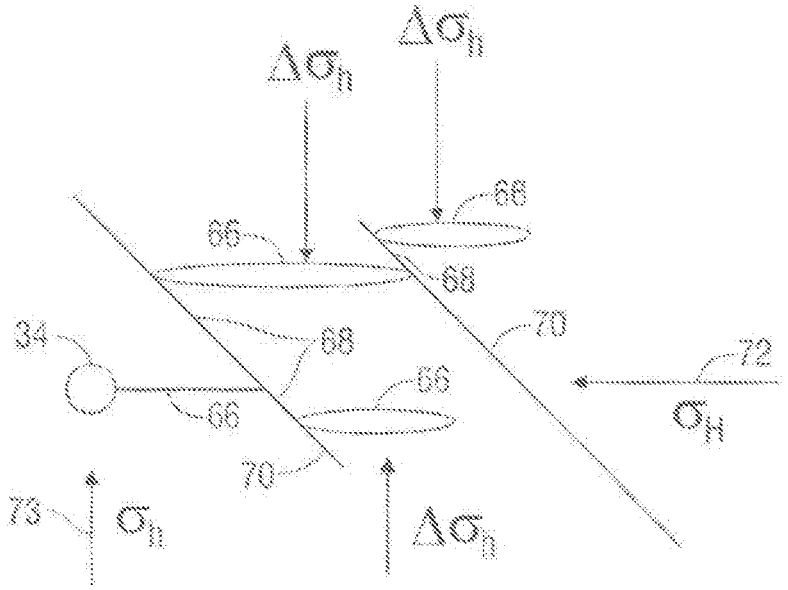

During hydraulic fracture propagation in a reservoir with interfaces 70, fracture complexity results from the interaction of the propagation fractures with the reservoir interfaces. The interfaces fail in shear locally and become sources for fracture branching. One potentially important condition for formation of the connector/step-over 68 is its oblique orientation with respect to the maximum horizontal stress 72, as illustrated in FIGS. 12A and 12B. This renders the connector fractures 68 more prone to close than other components of the fracture network. As illustrated, the main fracture branches 66 propagate generally parallel to the maximum horizontal stress 72.

Various conditions may be imposed to promote the desired closure of certain fractures, such as fracture connector/step-over branches 68. For example, the injection of fracture treatment material 40 may be stopped. The pumping rate of the fracture treatment material 40 may be reduced. Plugging agents, e.g. viscous fluid mixtures or foam, may be injected into the fracture. In some applications, oscillating pressure regimes obtained mechanically or otherwise at uphole or downhole locations may be used to force the desired connector/step-overs 68 to close intermittently. Once a desired fracture connector 68 closes, other branches (e.g. other fracture branches 66, 68) associated with the closed connector 68 become isolated from the rest of the fracture and remain pressurized, as illustrated in FIG. 12B.

The net pressure during the fracturing treatment is calculated as the fracture pressure minus the minimum horizontal stress and is monitored as a function of time during the treatment. Significant and indicative net pressure changes can result form the interaction of the growing fracture with reservoir discontinuities 70. The wellbore pressure changes enable an understanding of the evolution of the complex fracture geometries through an understanding of the effect of fracture connector formation to the pressure response.

Figure 13:
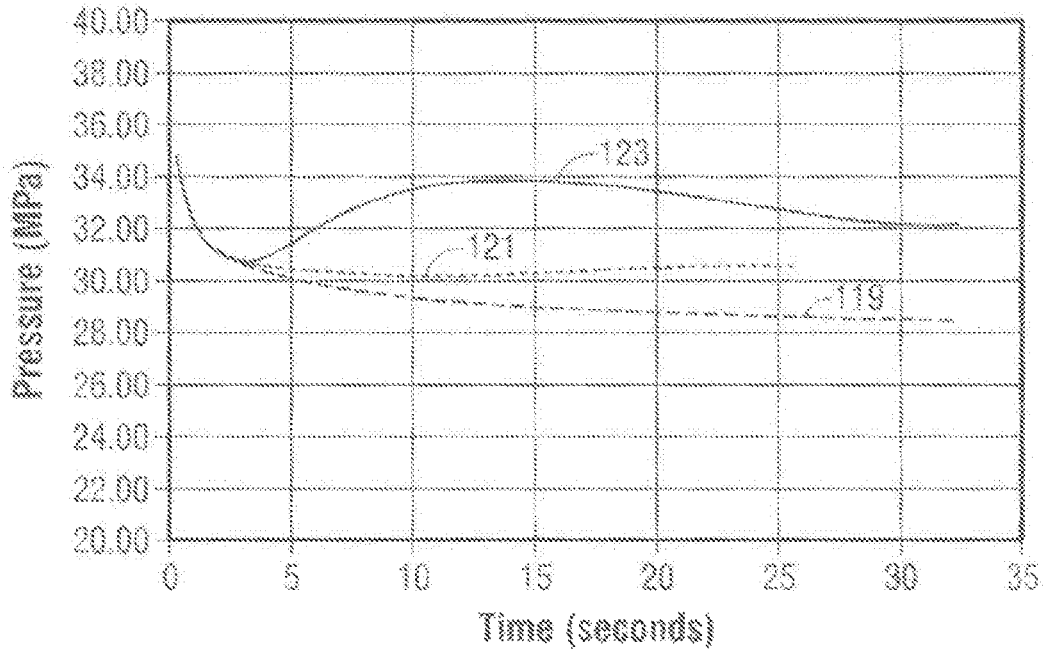
FIG. 13 is a graphical illustration of wellbore pressure as a function of time.

In FIG. 13, for example, a graph is provided which shows the pressure response as the fracture approaches and interacts with a discontinuity 70. The initial behavior is a reduction of pressure over time and is in line with the behavior of the growing fracture in the absence of discontinuities 119. The lower bound of this response is the value of the minimum horizontal stress. The subsequent change in pressure response which shows an increase in pressure as a function of time indicates interaction with the interface 121 for a condition of equal maximum and minimum horizontal stresses. The pressure stabilizes at a value slightly higher than the maximum horizontal stress. Where the maximum and minimum horizontal stresses are different, a different response 123 ensues. These features of the graphed pressure response enable verification of the desired fracture connector formation and thus a successful increase in fracture complexity.

Figure 14:
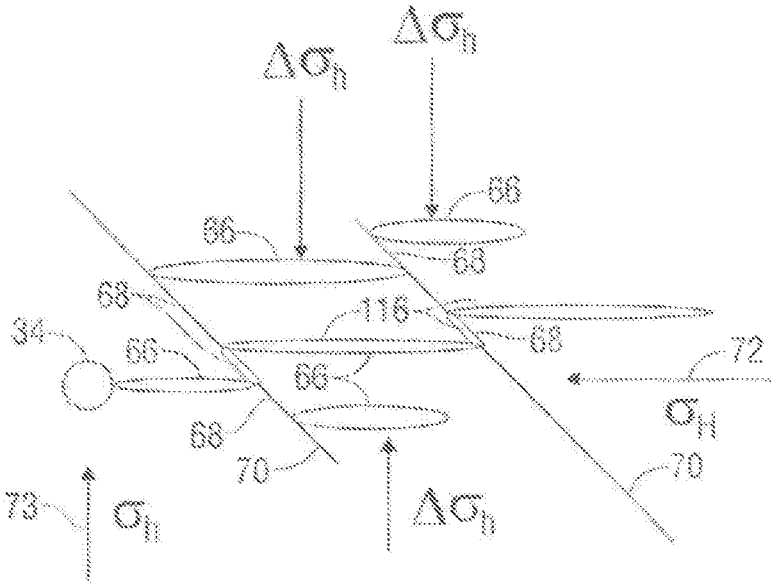
FIG. 14 is an illustration of fracture propagation after shutdown showing how fractures reinitiate along different paths.

As discussed above, one type of cycle for increasing the fracture density involves creating connectors/step-overs, closing them, and then re-pressurizing to generate new fractures and fracture branches 116, as illustrated in FIG. 14. The new fractures and fracture branches are generated from the truncated nodes that propagate along generally parallel paths to the original fracture paths, as illustrated. Consequently, the fracturing technique causes additional breakdown events, increasing net pressures, increasing surface area, and increasing acoustic emission events. Such events are desired indicators of successful application of the present technique.

The particular methodology employed to induce the development of additional surface area depends on the details of the operation. A variety of procedures may be used to obtain the same end result. For example, the controlled increase in fracture density resulting from the controlled closure and re-pressurization of the fracture region may comprise controlling the fracture treatment material pressure. However, other techniques may be employed, including controlling the treatment material flow rate, modifying the fluid properties, designing pump stages for fluids of contrasting properties, using plugging agents, delivering reactants or chemical agents into the subject formation, providing mechanical input applied downhole or at the surface, controlling flow to create surges in flow or pressure, cooling the formation, and other techniques able to control the closure connectors/step-overs 68 and the subsequent reinitiation of fracturing to increase fracture density.

Additionally, real-time monitoring of the development of acoustic emission events indicative of new fractures and resulting from the fracturing techniques discussed in the preceding paragraph enables one to ascertain the increase in fracture complexity. Monitoring the increase in fractures also enables adjustment in the fracturing techniques to optimize the increase in fracture complexity. For example, the treatment pressure or local flow rate may be changed to obtain a corresponding, desired change in acoustic emission events representing connector/fracture creation.

The controlled closure of connectors/step-overs 68 and the re-pressurization (or other subsequent fracturing technique) is repeated to increase the fracture complexity to a desired level. Generally, the closure and reinitiating cycle is continued until the fracture treatment has been completed and the desired number/length of fractures and surface area has been achieved.

This closure and reinitiating cycle may be carried out in either a manual mode or an automatic mode. In automatic mode, the cycling may be automatically controlled by a control system, such as a computer-based control system. This allows the process to be tuned so that the periods of connector closure and truncated fracture reinitiation promote maximum breakdown pressure, maximum pressure drop after breakdown, and/or maximum change in microseismic events.

Figure 15:
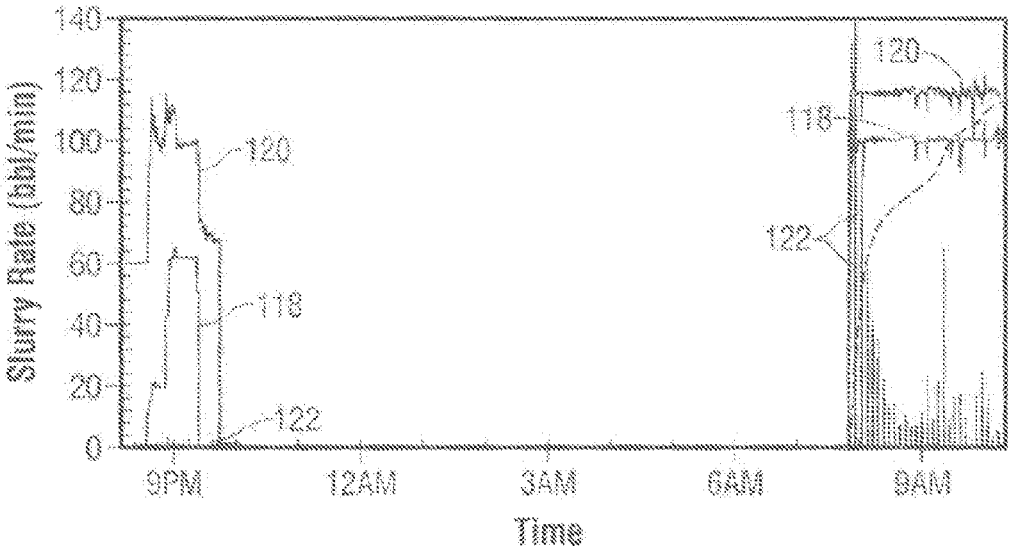
FIG. 15 is a graphical illustration showing the increase of fracture propagation due to the stopping and reinitiation of hydraulic fracturing.

Examples of field applications of the present technique are illustrated in FIGS. 15-19. In FIG. 15, for example, an application of the present methodology is illustrated graphically. In this example, fracture treatment material 40, e.g. fracturing slurry, is injected during an initial period at in injection rate represented by graph line 118 at a wellbore pressure represented by graph line 120. Acoustic emissions are recorded as indicated by graph line 122. The fracture propagation is then stopped and reinitiated with a considerably higher flow rate of fracture treatment material 40. The result displayed on the right side of the graph is the higher injection rate 118, higher wellbore pressure 120, and substantially increased measurement of the acoustic emissions 122. The substantial increase in acoustic emissions is indicative of a large number of additional fractures, thereby increasing the fracture complexity.

Figure 16:
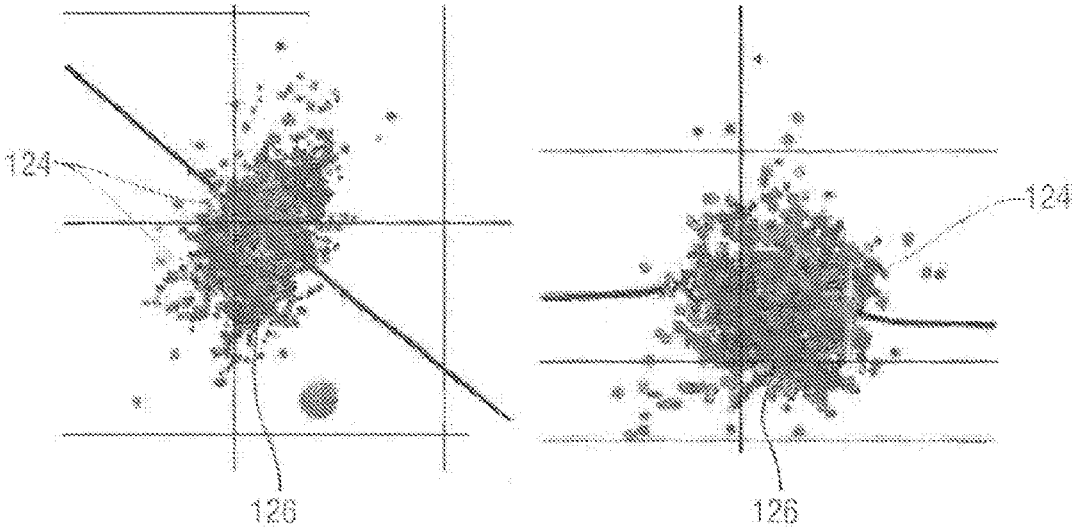
FIG. 16 is an illustration of recorded acoustic emission events representing an increase in fracturing and fracture density due to the fracturing technique employed.

The acoustic emissions may also be represented by dots or markers on a graph to indicate relative locations of the new fractures, as illustrated in FIG. 16. In this example, markers 124 indicate acoustic emission events which occurred during the first phase of fracturing. However, during the second phase of fracturing, a larger number of additional acoustic emission events occur, as represented by markers 126. The markers 126 are observed in the same general location as the previous markers 124, thus indicating a concentrated fracturing and a considerable increase in fracture density.

Figure 17:
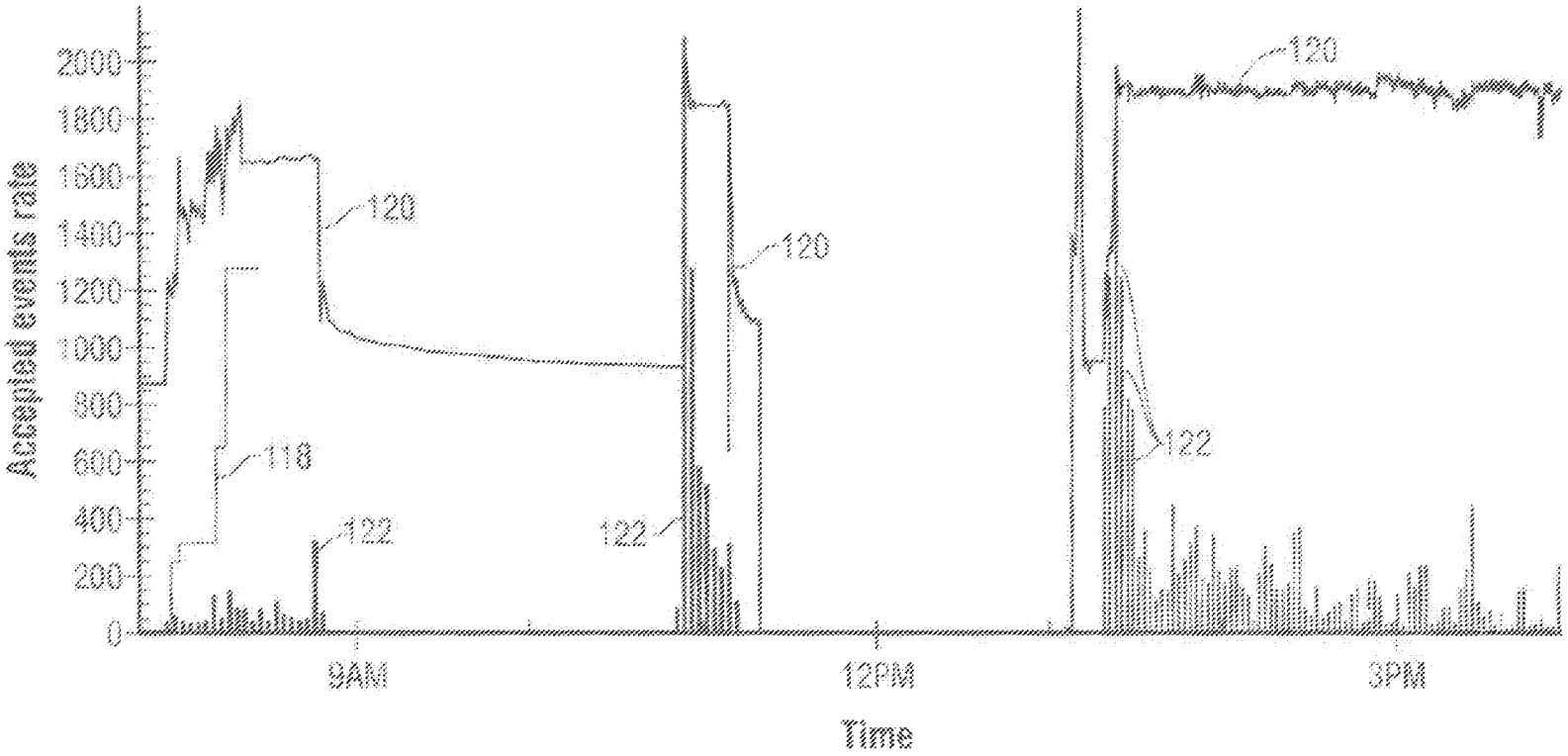
FIG. 17 is a graphical illustration of fracture cycling and the increase in acoustic emissions representative of an increase in surface area in the reservoir.

Referring generally to FIG. 17, another example of a field application of the present methodology is illustrated graphically. In this example, fracture propagation is stopped and reinitiated two subsequent times. As illustrated, each cycle leads to a considerable increase in acoustic emissions 122 representative of a corresponding increase in surface area.

Figure 18:
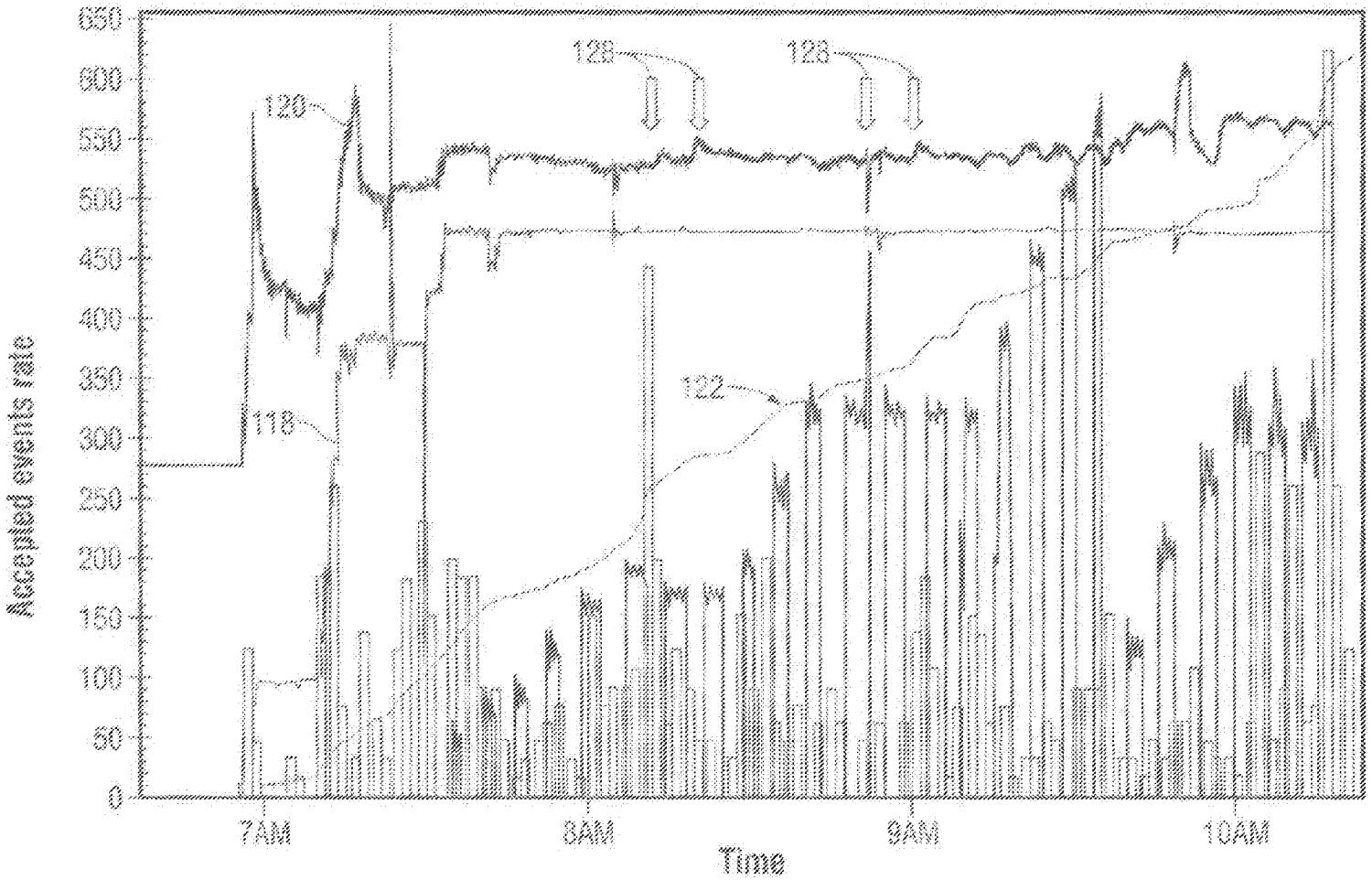
FIG. 18 is an illustration similar to that of FIG. 17 representing an alternate embodiment of the technique of the present invention in which the pumping of fracturing fluid is not stopped between fracturing cycles.

In another example of a field application of the present methodology, the fracture propagation is not stopped, as illustrated graphically in FIG. 18. In this application, fluid flow plugging agents, e.g. fibers, are pumped down with the fracture treatment material 40 until they reach fractures at locations indicated by arrows 128. The fibers plug the fractures and, as anticipated, closure and reinitiation of the fracture connectors/step-overs results in new fracture branches. The creation of new connectors is detected and observed via increased activity with respect to microseismic events 122, which provide an indication of the consequent increase in surface area.

Figure 19:
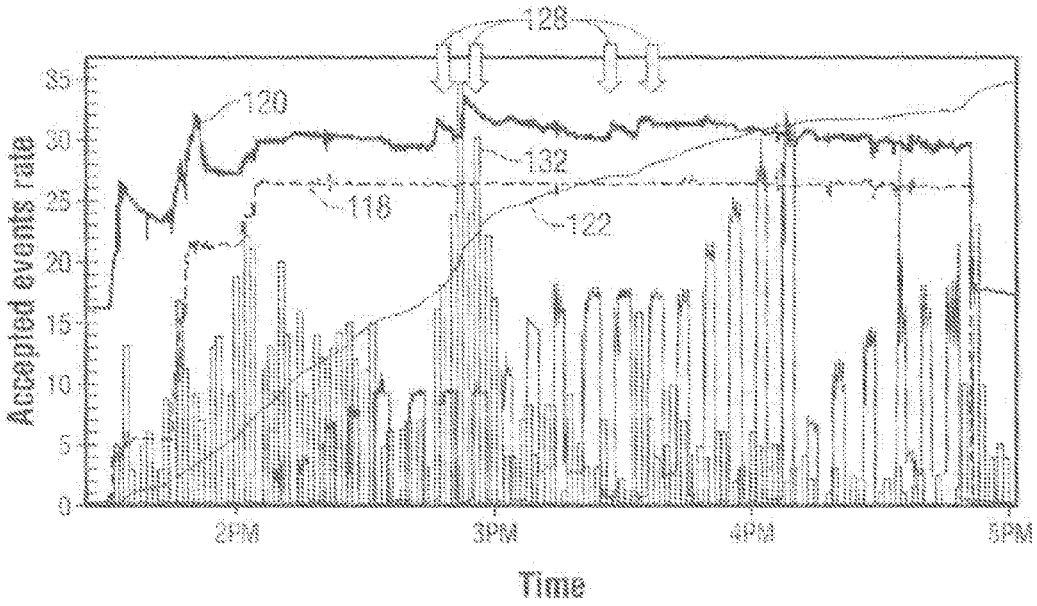
FIG. 19 is a graphical illustration of increased microseismic events representing increased fracture density due to the use of fluid flow plugged agents.
Figure 19:
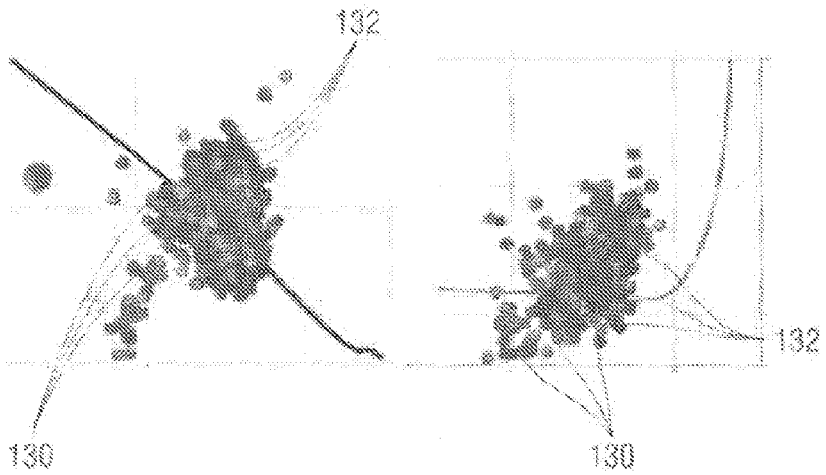

In FIG. 19, another illustration of the use of fluid flow plugging agents, e.g. fibers, is illustrated. The initial microseismic events are illustrated by markers 130 in the lower portion of the graphical representation. When the plugging agents reach the fracture, indicated by arrows 128, the fracture(s) is plugged, which effectively closes connectors, as discussed above. Once the subject connectors are closed, additional microseismic events are recorded, as indicated by markers 132. The graphical representation indicates a considerable increase in fracture density, and thus greater effective surface area, to enhance the production and recovery of hydrocarbons.

The data and procedures employed to carry out the present technique may be adjusted to optimize control over the increase in fraction complexity/density. According to one embodiment, an evaluation is initially performed regarding the local and regional in-situ stress, including vertical stress, horizontal stresses, and pore pressure. By way of example, such data may be obtained via various analysis tools, such as those available through the DataFRAC fracture data determination service available through Schlumberger Technology Corporation of Sugar Land, Tex. USA. The desired data may be collected via minifrac analysis (to determine, for example, horizontal stresses), bulk density analysis (to determine, for example, vertical stress), and MDT wireline formation tester analysis for evaluation of pore pressure, also available from Schlumberger Technology Corporation. The overall analysis typically is supported with detailed measurements of anisotropic elastic properties, e.g. from laboratory measurements or sonic scanner data. Further support for the analysis may be achieved through obtaining an understanding of the field conditions related to structural geometry, tectonic straining, subsidence and uplift, and the presence of nonconformities. Field data from induced fractures during drilling or coring, as well as borehole breakouts and event data during drilling (e.g. loss circulation), may be used to complement the analysis.

After obtaining the desired reservoir data and performing any needed analysis of the data, an evaluation of the normal and shear stresses acting at the planes of weakness is performed. In planes of weakness oriented perpendicular to the maximum horizontal stress, the normal stress is the maximum horizontal stress and the shear is negligible, except for certain alterations due to the formation rock being invariably heterogeneous.

The evaluation of normal and shear stresses enables calculation of the treatment pressure required to overcome the normal stress across the planes of weakness and thus to create a step-over connector 68. Additionally, the evaluation enables calculation of the treatment pressure required to maintain the step-over open after the fracture has propagated away from the interface. Knowledge of this treatment pressure also enables calculation of the treatment pressure below which a controlled closure of the step-over connector may be achieved. Additional evaluations also may be performed, e.g. evaluations of the resulting increase in acoustic events associated with the continuous pressure control. The well production in relation to a model or benchmark production for the region also may be compared and evaluated to determine whether the predictive model requires adjustment to achieve a better correspondence of actual data and predicted events.

Execution of the overall methodology for increasing fracture density and the consequential improvements to production and recovery of hydrocarbon may be adjusted according to the characteristics of a given reservoir 36. For example, one or more cycles may be applied during the course of a hydraulic fracturing treatment, and often numerous cycles are performed to increase the fracture density. An example of one cycle of the methodology is described in the following paragraphs.

The specific design of an individual cycle, however, may change through the course of the treatment in accordance with the data accumulated via, for example, acoustic emission data collection. By way of example, the cycles pumped at the end of a hydraulic fracturing treatment may differ from those pumped earlier in the treatment. In fact, the manner in which the cycle design is engineered to change during the course of a hydraulic fracturing treatment can have substantial influence on the resultant fracture network. The change in cycle design may be in response to feedback collected during the treatment from a variety of monitoring systems which provide desired monitoring data, e.g. real-time microseismic data, distributed temperature data, and/or pressure analysis data.

Furthermore, changes in cycle design may be selected to accommodate changes in proppant types and concentrations when pumped concurrently with the cycles or between the cycles. Alternatively, changes to the cycles may be due to a desire to affect results at different locations in the formation at different times in the treatment. For example, one treatment cycle may be designed to initiate such events far from the wellbore, while a subsequent treatment cycle may be designed to initiate switching events closer to the wellbore.

Although the present methodology has been described as implemented at one location in a fracture network, the technique also may be applied simultaneously or semi-simultaneously at two or more locations within the fracture network. For example, one cycle may be initiated and used to activate two or more switching events at different locations within the fracture network. Although the starting condition for a given cycle has been described as a fracture propagating through a step-out, an alternative starting condition may re-orient the fracture against the direction of minimum stress.

The cyclical approach of the present technique is adjusted according to the parameters of the reservoir and the equipment used to employ the technique. Additionally, subsequent cycles may be similar or dissimilar depending on the desired results and/or on the feedback from monitoring systems, e.g. seismic emission monitoring systems.

In one specific example of the methodology, the present technique comprises a cyclical process implemented during a hydraulic fracturing treatment. For example, knowledge of the reservoir fabric allows us to anticipate the manner by which the hydraulic fracture interacts with the existing mineralized fractures or weak interfaces to develop step-overs and branching. New fracture branches originating from these step-overs are then propagated for a desired period of time. Subsequently, a hydraulic fracturing treatment fluid additive (e.g., fibers) is delivered downhole to alter the treatment pressure and/or flow rate according to an engineered cycle designed to force the step-over to close. Closure of the step-over creates isolated, pressurized fracture branches that build up a high-stress field in the formation rock surrounding the isolated pressurized fracture branches. (Control for closing the step-overs can also be achieved by pressure or fluid rate control, without using fluid additives.).

In this example, mechanical closure of the step-over means that the step-over is unable to accept additional hydraulic fracturing treatment material, e.g. slurry, at a rate near to or within one order of magnitude of the pump rate, i.e. at a flow rate sufficiently high to sustain hydraulic fracture growth at a tip downstream of the step-out. Physically, mechanical closure means that the step-over is closed due to the high stress that it opens against, which is higher than that to maintain the fracture open, because of the orientation of the step-over in relation to the orientation of the fracture. It also may be closed by jamming or plugging the step-over with fibers, adequately sized proppant, and/or other bridging agents so that it is not able to except fluids at high rates. It should be noted that a mechanically closed step-out may be selectively, hydraulically opened, for the production of formation fluids and water at lower flow rates. (The opening may result from, for example, allowing the plugging agents to dissolve through contact with the producing fluids over time.).

Subsequently, the formation is re-pressurized at a pressure level sufficiently high to initiate another breakdown, fracture propagation, and another step-over at a different location within the fracture. In some applications, this re-pressurization may involve a transient overpressure spike. The specific cycle of closing the step-over and re-pressurizing the formation to initiate another step-out may be achieved according to a variety of techniques. For example, the closure and subsequent re-pressurization may be achieved by a change in flow rate, a change in the applied hydraulic pressure, and/or a change in the additives of the fracture treatment material 40. Individual changes or combinations of these various changes may be used to establish a pulse sequence designed to create a synergistic effect between the various processes to facilitate closure of one step-over and opening of a second.

Accordingly, the present technique of enhancing the fracture network may have a variety of components, aspects, cycles, and cycle changes. Effectively, the technique enables control of the evolution of fracture complexity and is designed to promote the closure of fracture connectors and the initiation of additional fractures from truncated branches. The evolution of fracture complexity often is controlled through a cyclical process involving selected use of parameters including time, pressure, fluid and/or additive concentrations, as described above. Additionally, uphole and/or downhole mechanical devices, e.g. chokes, valves, and other flow control devices, may be utilized in tubing string 60 to control the desired flow of fracture treatment material 40.

If additives are used in the fracture treatment material to cause closure of step-overs, the additives may be solid state diversion agents, liquid diversion agents, reactive fluids, e.g. acid or chelating agent, viscosified slugs, or other additives suitable for causing closure of the fracture connectors. Such additives and/or fluid pulses may have a programmable lifetime selected to enhance the closure of the fracture connectors. Additionally, additives may be used to assist in the mechanical closure of the fracture connectors. Such additives may contain temporary or permanent diverting agents to help limit flow into the closing connectors.

Pressure and flow rate cycles of the fracturing treatment material 40 may be generated by a variety of systems and devices. For example, changes in the rate of flow may be controlled by hydraulic pumps, e.g. pumper unit 52. The pressure and flow rate cycles may also be controlled by the intervention of coiled tubing, by the activation of a chamber, by the use of an explosive or combustible device, propellants, or by other mechanisms designed to control the desired evolution of fracture complexity.

In operation, the methodology described herein applies to heterogeneous reservoirs that exhibit an adequate number of discontinuities in the form of interfaces, mineralized fractures, bed boundaries, and lithologic discontinuities which represent planes of weakness. These features are typical and common in heterogeneous reservoirs (unconventional plays) and less common or nonexistent in homogeneous reservoirs (conventional plays). Given that hydraulic fractures develop very differently in heterogeneous formations (as dictated by the degree of heterogeneity), the present methodology uses an understanding of the degree of textural heterogeneity in the reservoir to infer the type of fracture complexity anticipated, including the length and orientation of the step-overs, to potentially promote additional complexity. Thus, an initial portion of the technique is an evaluation of the textural heterogeneity of the reservoir by indentifying the presence, orientation, and density of weak interfaces (i.e., mineralized or open fractures, lithologic contacts, bed boundaries, interfaces due to concretions or inclusions) to define the effect of these on fracture propagation.

The evaluation is performed by conducting geologic observations and mapping on core and borehole imaging logs, and by extending these to the regions between wells through the use of seismic data and regional reologic models. (see FIGS. 8, 9, and 10). The magnitude of the in-situ stress (vertical and horizontal stresses) and their orientation in relation to the predominant orientation of the interfaces (see FIGS. 6A-6D) also is determined. Changes in the orientation of these planes of weakness (i.e., rock fabric) and the in-situ stress has a direct consequence on the generation of fracture complexity (as shown in FIGS. 6A-6D).

The outcome of the above analysis is the prediction of whether the heterogeneous reservoir will result in complex hydraulic fractures or not. This prediction can be validated and improved on the basis of microseismic monitoring (see FIG. 4). If the heterogeneous reservoir (with heterogeneous fabric) is not conductive to fracture complexity and the generation of step-overs (by the interaction of the hydraulic fractures with the planes of weakness), the improvements may be limited to, for example, the simple fractures, as illustrated in FIGS. 6C and 6D. If the heterogeneous reservoir (with heterogeneous fabric) is conductive to fracture complexity and the generation of step-overs, the present method provides substantial improvements in production by exercising and controlling the fracture complexity and increasing the surface area, as illustrated by the complex fractures in FIG. 6B.

According to one embodiment, simple fractures are created near the wellbore, and complex fractures (with high fracture surface area per unit reservoir volume) are created away from the wellbore. This results in good connectivity between the large created surface area and the wellbore. The desired fractures are achieved by first understanding the reservoir (as indicated above).

Based on the reservoir understanding (textural heterogeneity and its relation with stress magnitudes and orientations, decisions may be made as follows: If the textural heterogeneity is weak (homogeneous reservoir) or if the orientation of the heterogeneous fabric is parallel to the maximum and intermediate stresses, or if the stress contrast is considerably larger than the contrast in properties between the host reservoir rock and the planes of weakness, or if there is no stress contrast, a different methodology relative to the approach described herein may be employed. For example, smaller fractures and an increased number of stages may be promoted.

If the textural heterogeneity is strong, and the orientation of the heterogeneous fabric is oblique to the maximum and intermediate stress orientation, and the stress contrast is adequate (in relation to the strength contrast between the host rock and the planes of weakness), then the current method applies. In this scenario, the information known (near wellbore) is used to design the perforating system and the spacing of the perforation clusters to promote a single conductive fracture with minimal tortuosity emanating from the wellbore. Typically this requires deep penetrating charges and closely spaced clusters.

Then, the fracture is monitored, as it propagates, via pressure-time measurements and acoustic emission real-time localization (or other suitable techniques). As the fracture grows and interacts with the planes of weakness, step-overs and multiple branches are generated (as shown in FIG. 3 and FIG. 18). The measurements are used to decide how and when to proceed with the stress or flow control cycles described above.

For example, the flow rate may be progressively increased to ensure the pressure in a significant part of the fracture is above the stress acting normal to the discontinuity (hence the need to know the discontinuity orientation and the estimate of this normal stress). Sometimes, if the flow rate cannot be high enough, once the fracture has developed as far as desired, a tip screen out may be conducted (increasing the proppant concentration, or using additives) which allows the pressure to increase above the relevant normal stress. Injecting a very cold fluid to take advantages of thermal effects, and to decrease the local value of the maximum horizontal stress is another manner to accomplish the same results.

Technologies are available for sending acoustic waves, once the fracture is wide open, for fracture characterization (length). The present methodology is amenable to using elastic waves and tuning the wave frequency to more effectively control the evolution of the step-overs and the resulting growth of additional fractures, from the truncated branches (see FIG. 15). If the natural fractures have conductivity (if they are partially mineralized) but the conductivity is low enough to permit fracture complexity, a low pumping rate may initially be employed to open the fractures and generate shear. The pumping rate is then switched to a high flow rate to generate step-overs. This is the reason the properties of these planes of weakness are characterized based on core samples. Subsequently, the flow rate is lowered for the pressure to be below the relevant normal stress, pumping is stopped, or a force closure is performed followed by a new pumping cycle. Adding the pumping phase to create complexity with measurements, process, and criterion to promote complexity further differentiates the present methodology from existing approaches.

Mathematical models may be employed for evaluating the generation of step-overs based on the presence of interfaces, their mechanical properties, the orientation of these as relation of the in-situ stress, the magnitude of the in-situ stress, and the applied hydraulic pressure or flow rate. An example of an appropriate mathematical model is described in the paper: Thiercelin, *Hydraulic Fracture Propagation in Discontinuous Media*, Schlumberger Regional Technology Center, Unconventional gas, Addison, Tex., USA (2009).

Concerning analytical modeling, criterion have been developed for predicting whether a propagating fracture will terminate at or cross an interface and develop a step-over. One model developed by Renshaw and Pollard is based on a first order analysis of the stress field near the tip of a tensile (Mode 1) fracture which interacts with a cohesionless frictional interface. The fracture is oriented perpendicularly to this interface. It is proposed that crossing will occur if the magnitude of the compression acting perpendicular to the frictional interface is sufficient to prevent slip along the interface and if the stress ahead of the fracture tip is sufficient to initiate a fracture on the opposite side of the interface. Fracture reinitiation is assumed to occur prior to the fracture reaching the interface. It should be noted that a variety of modeling techniques may be employed to help determine the best approach and environment for conducting the methodology described herein.

Furthermore, various fluids/additives also may be designed to assist in providing the desired pressure effects for controlling fracture complexity. For example, a short diverting plug immediately followed by a short slug of high quality foam (a highly compressible fluid) may be delivered downhole into the wellbore 34. The short diverting agent catches in the perforations or fractures and begins to build up pressure. The compressible fluid/foam behind the diverting stage then performs two functions. The compressible fluid/foam buffers the surface equipment from a rapid pressure spike and it begins to compress and store energy. When the diverting agent releases, a drop in pressure results and the compressible fluid/foam expands to cause additional work, e.g. fracturing, on the fracture network. A variety of foam fluids, additives for foam fluids, compliant fluids, and other materials may be employed to enhance the control and occurrence of connector closure events.

In some applications, the additives may be engineered to fail, change, and/or disintegrate at a predetermined pressure to facilitate closure of the fracture connectors. For example, the additive may comprise collapsible hollow spheres which collapse under a predetermined pressure to facilitate closure of the fracture connectors. In other applications, an alternate embodiment may employ a micro-scale version of the process that may be implemented during a fracture data determination service. Also, many of the flow rates, pressures, additives, cycle changes, and other adjustments may be made based on data obtained from microseismic acoustic emission detection and/or other monitoring of the fracture events occurring in a given reservoir region.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A method of improving a fracturing treatment, comprising:

determining fracture characteristics of a heterogeneous reservoir;

delivering a fracture treatment material downhole at a pressure selected to create a plurality of fractures and fracture connectors based on the fracture characteristics of the heterogeneous reservoir;

monitoring the creation of fracture connectors;

closing fracture connectors to isolate fracture branches;

subsequently reinstating formation of fracture connectors to increase the number of fracture connectors and thus the fracture complexity and formation conductivity; and adjusting the methodology of subsequently reinstating formation of fracture connectors based on real-time data obtained from monitoring, wherein adjusting the methodology of subsequently reinstating formation of fracture connectors comprises adjusting based on a comparison of acoustic emission measurements with a predicted fracture growth.

2. The method as recited in claim 1, wherein monitoring the creation of fracture connectors comprises seismic monitoring.

3. The method as recited in claim 1, wherein determining the fracture characteristics of the heterogeneous reservoir comprises determining characteristics via large-scale seismic prospection and wellbore imaging.

4. The method as recited in claim 1, further comprising automating and repeating the delivery of fracture treatment material; closing the fracture connectors; and subsequently reinstating formation of additional fracture connectors to maximize reservoir conductivity.

5. A method of improving a fracturing treatment comprising:

determining fracture characteristics of a heterogeneous reservoir, wherein determining the fracture characteristics of the heterogeneous reservoir comprises determining a magnitude of the minimum horizontal stress and the maximum horizontal stress;

delivering a fracture treatment material downhole at a pressure selected to create a plurality of fractures and fracture connectors based on the fracture characteristics of the heterogeneous reservoir;

monitoring the creation of fracture connectors;

closing fracture connectors to isolate fracture branches; and subsequently reinstating formation of fracture connectors to increase the number of fracture connectors and thus the fracture complexity and formation conductivity.

6. A method of improving a fracturing treatment, comprising:

determining fracture characteristics of a heterogeneous reservoir, wherein determining the fracture characteristics of the heterogeneous reservoir comprises determining the principal rock classes of the heterogeneous reservoir from log measurements;

delivering a fracture treatment material downhole at a pressure selected to create a plurality of fractures and fracture connectors based on the fracture characteristics of the heterogeneous reservoir;

monitoring the creation of fracture connectors;

closing fracture connectors to isolate fracture branches; and subsequently reinstating formation of fracture connectors to increase the number of fracture connectors and thus the fracture complexity and formation conductivity.

* * * * *

UNITED STATES PATENT AND TRADEMARK OFFICE

CERTIFICATE OF CORRECTION

PATENT NO. : 9,140,109 B2
APPLICATION NO. : 13/515229
DATED : September 22, 2015
INVENTOR(S) : Roberto Suarez-Rivera et al.

It is certified that error appears in the above-identified patent and that said Letters Patent is hereby corrected as shown below:

On the title page item [75] Second Inventor delete "Dean M. Wulberg" insert --Dean M. Willberg--.

Signed and Sealed this
Eighth Day of March, 2016

Michelle K. Lee

Michelle K. Lee
*Director of the United States Patent and Trademark Office*